US005222596A

United States Patent [19]

Jordan

[11] Patent Number: 5,222,596

[45] Date of Patent: Jun. 29, 1993

[54] CLUB HOLDER FOR A GOLF BAG

[76] Inventor: David Jordan, 24513 Custis, Southfield, Mich. 48075

[21] Appl. No.: 774,709

[22] Filed: Oct. 9, 1991

Related U.S. Application Data

[63] Continuation-in-part of Ser. No. 634,720, Dec. 27, 1990, abandoned.

[51] Int. Cl.[5] ..... A63B 55/00

[52] U.S. Cl. ..... 206/315.6; 206/315.3

[58] Field of Search ..... 206/315.2–315.8; 211/70.2

[56] References Cited

U.S. PATENT DOCUMENTS

| | | | |
|---|---|---|---|
| 1,107,283 | 8/1914 | Gamble . | |
| 1,227,657 | 5/1917 | Pierce | 206/315.6 |
| 1,756,902 | 4/1930 | Boyce . | |
| 1,833,534 | 11/1931 | Remfrey . | |
| 2,143,644 | 1/1939 | Borm | 206/315.3 X |
| 2,508,264 | 5/1950 | Johnson . | |
| 2,520,226 | 8/1950 | Smith . | |
| 2,546,416 | 3/1951 | Alter et al. | 206/315.6 |
| 2,551,780 | 5/1951 | Wood . | |
| 3,139,132 | 6/1964 | Shiller | 206/315.6 |
| 3,331,419 | 7/1967 | Bencriscutto | 206/315.6 |
| 3,503,518 | 3/1970 | Black . | |
| 4,100,652 | 7/1978 | Carlson | 206/315.6 X |
| 4,130,153 | 12/1978 | Zopf . | |
| 4,181,167 | 1/1980 | Ret . | |
| 4,194,547 | 3/1980 | Sidor et al. . | |
| 4,208,227 | 6/1980 | Cowan | 206/315.6 |
| 4,304,278 | 12/1981 | Ruhlandt | 206/315.6 |
| 4,667,820 | 5/1987 | Solheim | 206/315.6 |
| 4,691,823 | 9/1987 | Pape | 206/315.6 |
| 4,915,221 | 4/1990 | Spangler . | |
| 5,029,703 | 7/1991 | Dulyea, Sr. | 206/315.6 X |

FOREIGN PATENT DOCUMENTS

| | | | |
|---|---|---|---|
| 21884 | 8/1930 | Australia | 206/315.5 |
| 280427 | 11/1927 | United Kingdom . | |
| 332636 | 7/1930 | United Kingdom | 206/315.5 |
| 347581 | 7/1931 | United Kingdom . | |
| 705115 | 3/1954 | United Kingdom | 206/315.5 |

*Primary Examiner*—Sue A. Weaver
*Attorney, Agent, or Firm*—Brooks & Kushman

[57] ABSTRACT

A club holder securable within the open end of golf bag by a strap which extends back and forth thereacross is disclosed. The club holder has a plurality of retainers disposed about its inner periphery for releasably securing about the shafts of golf clubs. The holder has an enclosed channel for threadably receiving the strap when the holder is in the open end of the golf bag, the strap cooperating with the channel to prevent the holder from being withdrawn from the golf bag. The holder may be unitarily molded or be a longitudinal strip with ends that are securable together to provide closure. Retainers may either be integral or releasably securable to a base portion. The base portion may have a second channel for releasably securing the retainers. The invention further comprises a base insert, positionable in the bottom of a golf bag, having a crowned center portion, a peripheral outer lip and a groove disposed therebetween for receiving the grip of a golf club. The retainers and the groove cooperate to maintain the shafts of golf clubs in an ordered, generally parallel relation with respect to one another.

20 Claims, 5 Drawing Sheets

CLUB HOLDER FOR A GOLF BAG

CROSS-REFERENCE TO RELATED APPLICATION

This is a continuation-in-part application of U.S. application Ser. No. 07/634,720 entitled "Club Caddy", which was filed on Dec. 27, 1990 and is now abandoned.

TECHNICAL FIELD

This invention relates generally to golf club bags and more particularly to inserts mounted inside golf bags to hold golf clubs in an orderly fashion.

BACKGROUND ART

A golf club bag conventionally has a pair of parallel dividers extending across its open end or mouth providing three separate compartments. The dividers are usually supported by a strap or belt which traverses back and forth across the mouth between two pairs of diametrically opposed openings located adjacent the top edge of the bag. The ends of the strap or belt have a plurality of apertures and a buckle, respectively, so that they may be joined together.

Wood clubs are generally placed in one compartment with the two remaining compartments being used to hold iron clubs, a putter and other accessories. A particular disadvantage to this system is that the shafts of the clubs are free to rub against one another thereby scratching or scuffing the shafts. Graphite shafts are particularly susceptible to this damage. Further, this loose arrangement leaves the clubs disorganized and unsightly, making the locating of a specific club more difficult.

One solution to this problem is to provide retainers which releasably clamp about and position the shafts of clubs so that they cannot scrape against one another. These retainers may either be secured directly to the golf bag or else be affixed to an insert which is secured in the mouth of the golf bag. A number of patents illustrate the securement of retainers relative to a golf bag.

Remfrey, U.S. Pat. No. 1,833,534 and Purdie, Great Britain Pat. No. 280,427, disclose golf bags having a number of resilient clips or brackets, each adapted to clampingly retain the shaft of a club. The clips are secured directly within the mouth of the bag by screws or rivets.

Black, U.S. Pat. No. 3,503,518, discloses a golf club holder for a bag. The holder has a vertical curved wall having around its upper edge a series of raised outwardly exposed grooves for receiving the blades of iron clubs. A plurality of spaced notches are located around the inner periphery of the holder to secure shafts of clubs. The holder, in turn, is secured to the golf bag by rivets. A divider separates the holder from a compartment which is shown to store wood clubs.

Sidor et al, U.S. Pat. No. 4,194,547, discloses a golf club holder. The holder is comprised of tubes having disc like tube sheets at either end and a rack which has clips which are glued, riveted or otherwise secured thereto. The plurality of tubes and pair of tube sheets are placed within the bag and retained vertically therewithin with a strap extending across the mouth of the bag. The rack has a pair of open slots which slide over and rest upon a pair of dividers supported by the strap. To ensure the rack does not come loose when clubs are withdrawn, the rack is permanently secured to the open end of the bag with glue or screws.

Ret, U.S. Pat. No. 4,181,167, discloses a club organizer for a golf bag. The club organizer consists of a round base, fourteen space tubes for receiving club shafts, and a club holder which is secured to the top of the tubes and has along its inner periphery a series of resilient notches for securing golf clubs. The organizer may be used alone or placed within a bag. The reference fails specify if or how the organizer is to be affixed to the bag.

Boyce, U.S. Pat. No. 1,756,901, discloses a golf club carrier. The carrier comprises an arcuate metal strip mounted to the top edge of a golf bag by metal clips. The carrier further has an arcuate racklike member having circular openings for reception of club shafts. U-shaped bracket members secure the racklike member to the metal strip.

Other patents illustrating retainers which generally retain and organize the shafts of golf clubs include U.S. Pat. Nos. 4,915,221, 2,551,780, 2,520,226, 2,508,264 and Great Britain Pat. No. 347,581.

The above club holders generally suffer from the disadvantage that they are permanently installed within golf bag. Typically, rivet or glue means is used to secure the club holders within mouths of the golf bags. The club holders which are not permanently affixed to their respective golf bags, either fail to rigidly retain the club holder within the bag or else may wear upon the bag, such as by the metal clips in Boyce or else the sliding of the organizer within a bag as taught by Ret.

The present invention seeks to solve the problems inherent in the above-identified patents.

SUMMARY OF THE INVENTION

The present invention is a golf club holder adapted to fit within the open end of a golf club bag. The club holder is releasably secured thereto by a strap or belt which traverses back and forth between pairs of openings located adjacent the top of the bag.

The club holder has a plurality of retainers thereon positioned around the open end when the holder is within the golf bag to releasably retain clubs therewithin. The holder has a enclosed channel for threadably receiving and cooperating with the strap to prevent the holder from being withdrawn from the open end of a golf bag when a club is released from a retainer.

The invention may be of a one-piece construction wherein the club holder is preferably of a unitary molded design. Alternatively, the club holder may have a base portion to which a determinable number of retainers are releasably securable. The base portion may include a second channel for slidably receiving and retaining a plurality of retainer clips.

The enclosed channel may extend around the holder to completely enclose the strap, with the exception of channel access openings which permit the strap to secure about the mouth of the bag. Alternatively, the enclosed channel may be formed by a plurality circumferentially spaced loops or else fingers which are securable about the strap to prevent the strap from becoming disengaed from the channel other than by being longitudinally withdrawn from the channel access opening.

The club holder may be elongate and conformable in size relative to inner diameter of the open end of the bag with the strap's ends being securable together in overlapping relation or else the club holder may be of a closed, circular configuration.

Further included in the invention is a base insert having a crowned center portion with a peripheral circumferential groove thereabout for receiving the grips of golf clubs, the groove and the retainers cooperating to maintain shafts of golf clubs in generally ordered parallel relation.

It is an object of the present invention to provide a club holder having an enclosed channel for receiving a strap therein which, in turn, is releasably securable to the open end or mouth a golf bag, thereby providing securement of the club holder relative to a golf bag.

It is another object to provide a club holder which can releasably secure a determinable number of retainers clips within the mouth of a golf bag.

It is a further object to provide a golf holder which is releasably securable to a golf bag without causing excessive wear to the golf bag.

It is yet another object of the present invention to provide a club holder which is conformable in size to golf bags having open ends or mouths of different diameters.

It is still yet another object to provide a club holder which is interchangeable with a conventional parallel pair of dividers in the mouth of a golf bag, the dividers also being supported by a strap transversing the mouth.

Still another object is to provide a base having a crowned center portion and a peripheral groove, positionable in the bottom of a golf bag, wherein the groove retains the grips of golf clubs, in cooperation with the club holder, so that the shafts of golf clubs may not cross over and rub against one another.

Other objects, advantages and features will become more readily apparent from the following description and accompanying sheets of drawings.

BEST MODES FOR CARRYING OUT THE INVENTION

Figure 1:
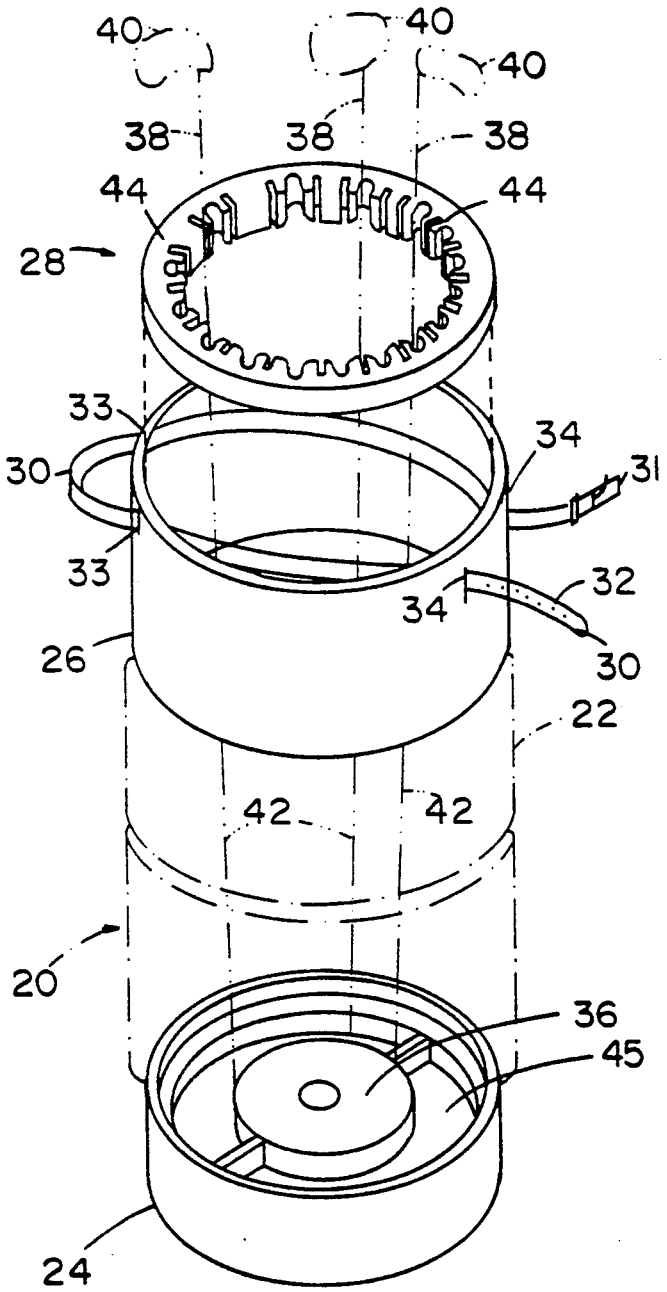
FIG. 1 is an exploded schematic perspective view, partially in phantom, of a first embodiment of a club holder and a base, made in accordance with the present invention, positioned within a golf bag having a strap transversing back and forth across its open end or mouth.

FIG. 1 shows a golf bag 20 having a center portion 22, shown in phantom, a bottom portion 24 and a mouth portion 26. The mouth portion 26 is generally circular and made of a resilient material. A club holder 28 is retained within the mouth portion 26 of golf bag 20 by a strap or belt 30. The ends of strap 30 have a buckle 31 and a plurality of apertures 32, respectively. Bag 20 has two pair of diametrically opposed strap openings 33 and 34 for receiving the strap 30 therethrough so that strap 30 may traverse back and forth across the mouth portion 26 while securing to bag 20.

A base insert 36, configured and sized to snugly fit within bottom portion 24, may be inserted through mouth portion 26 and positioned upon bottom portion 24. Golf clubs 38 are shown schematically with heads 40 and shafts 42. Club holder 28 has a plurality of retainer portions 44 located along its inner radial periphery and base insert 36 has a circumferential groove 45. Retainer portions 44 and groove 45 cooperate to retain the shafts 42 of golf clubs 38 in ordered generally parallel spaced relation.

Figure 2:
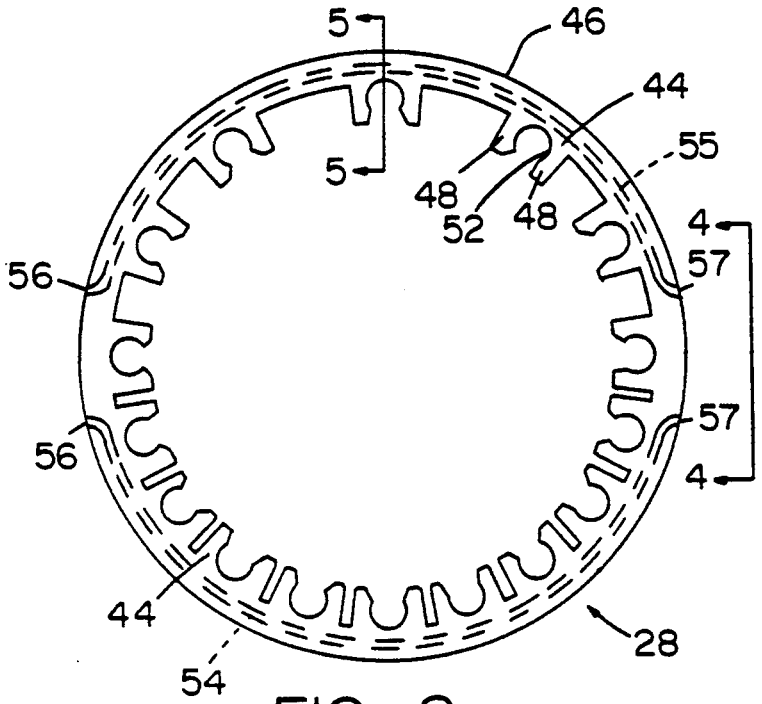
FIG. 2 is a top view of a first embodiment of the club holder.
Figure 5:
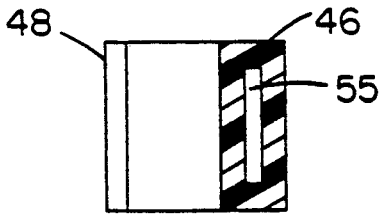
FIG. 5 is a sectional view taken along line 5—5 of FIG. 2.

FIG. 2 shows a top view of a first preferred embodiment of the club holder 28, which is preferably a unitarily molding of a resilient material such as a high strength plastic. Club holder 28 has a base portion 46 to which a plurality of retainer portions 44 are joined, each retainer portion 44 having a pair of cooperating resilient fingers 48 which are sized and configured to releasingly and clampingly retain a shaft 42 therewlthin. Preferably, an inner aperture 50 which is formed by each pair of cooperating fingers 48, is lined with a felt material 52 or the like which will prevent the scratching of the shafts 42 when retained within retainer portions 44. FIG. 5 shows a sectional view through a retainer portion 44 which is typical of the retainer portions.

Figure 4:
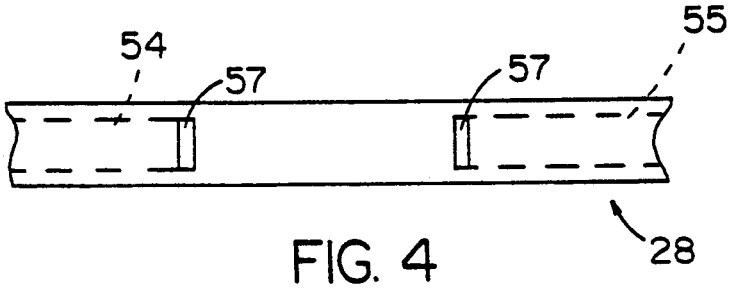
FIG. 4 is a fragmentary side elevational view of the club holder of FIG. 2, taken along line 4—4.

Base portion 46 has a pair of diametrically opposed circumferentially extending channels 54 and 55 which are sized to receive strap 30 therethrough. Preferably channel 54 is enclosed within base portion 46, however it is within the scope of this invention to use any other retainer means for securing about strap 30 such that the club holder 28 is releasably secured to the golf bag 20, with the retainer means preventing the club holder 28 from being withdrawn from the golf bag 20. The retainer means might include belt-receiving type loops or cooperating projections extending from the base portion 46. In order to access first and second channels 54 and 55, channel access openings 56 and 57 are provided on diametrically opposed sections of base portion 46. FIG. 4 shows a side view of the channel access opening 56 and 57.

In operation, club holder 28 is positioned within mouth portion 26. The free end of strap 30 is inserted through a bag opening 34 and channel access opening 56, threaded through channel 54, exiting channel access opening 57 and bag opening 56. This process is repeated with the free end of strap 30 circumferentially extending radially outside mouth portion 26 and being inserted into the remaining bag opening 33 and channel access opening 56, threaded through channel 55, and exiting channel opening 57 and bag opening 34. Strap 30 is then pulled taut with buckle 31 securing to an appropriate aperture 32 in strap 30, whereby club holder 28 is releasably secured to golf bag 20 by strap 30.

Golf clubs 38 having shafts 42 may then be placed in golf bag 20, grip ends first, with shafts 42 being forced between cooperating fingers 48 into inner aperture 50 to clampingly and releasably retaining golf clubs 38 therewithin. If the shafts 42 are sufficiently short so as not to contact the base insert 36, the club heads 40 may rest upon the top surfaces of retainer portions 44.

If the golf bag 20 has previously had a standard pair of parallel dividers supported by strap 30, the dividers may be reinstalled in golf bag 20 simply by removing strap 30 from club holder 28 and reinstalling the dividers upon strap 30.

Figure 3:
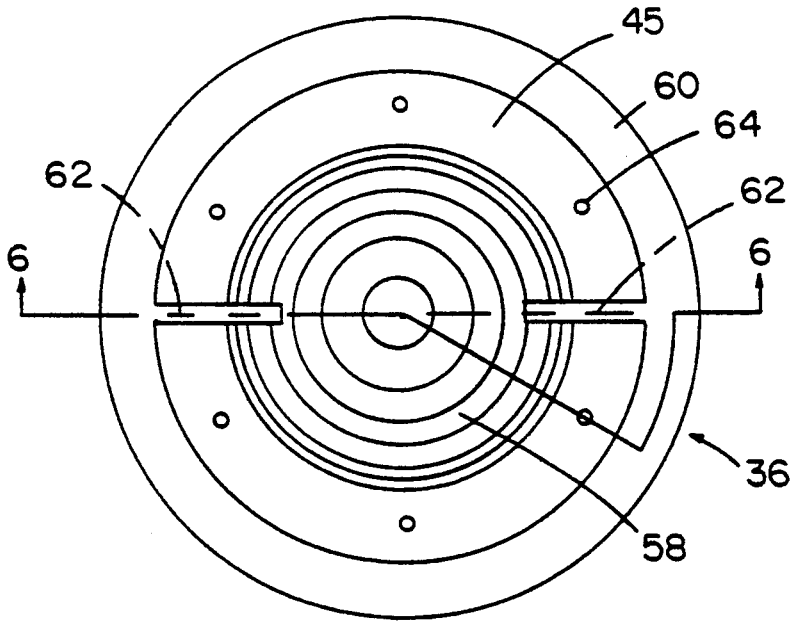
FIG. 3 is a top view of the base.
Figure 6:
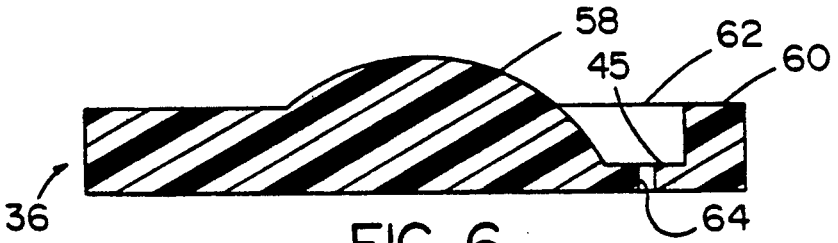
FIG. 6 is a sectional view taken along line 6—6 of FIG. 3.

A preferred embodiment of the base insert 36 is shown in FIG. 3. Base insert 36 has a crowned center portion 58, a circumferentially and upwardly extending peripheral lip 60 forming circumferential groove 45 therebetween. Ideally, groove 45 is only wide enough to accommodate the grip of one shaft 42. Ribs 62, extending between crowned center portion 58 and peripheral lip 60, may be added to provide additional structural stiffness to base insert 36. Also drainage apertures 64 are provided in groove 45 to allow water to drain from base insert 36. A cross-sectional view of base insert 36 is shown in FIG. 6.

Figure 7:
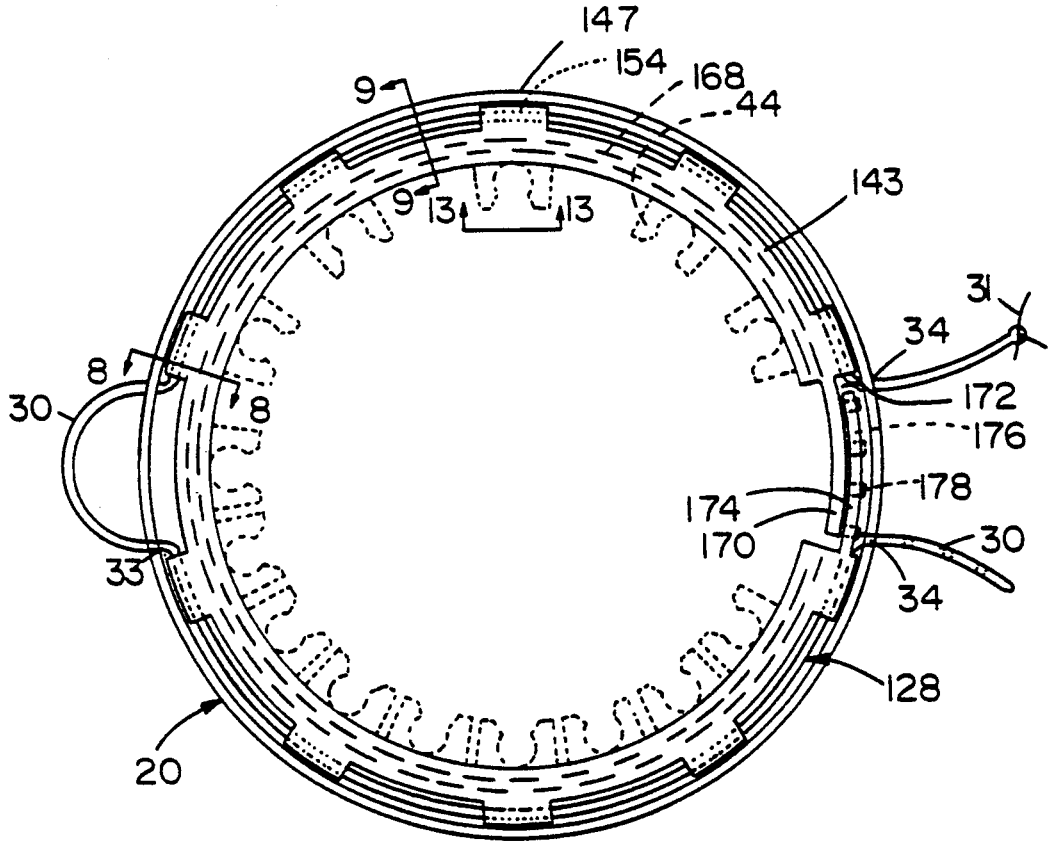
FIG. 7 is a top view of an alternative embodiment of a club holder, also made in accordance with the present invention.
Figure 8:
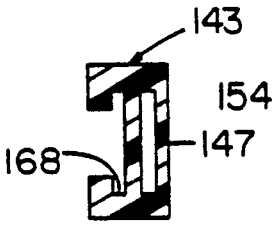
FIG. 8 is a sectional view taken along line 8—8 of FIG. 7 showing just the club holder.
Figure 9:
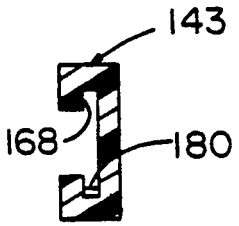
FIG. 9 is a sectional view taken along line 9—9 of FIG. 7.

A second embodiment of a club holder 128 is shown in FIGS. 7–12. Club holder 128 includes a base portion 143 having a channel 154 formed of a plurality of circumferentially spaced belt-like loops 147, channel 154 being sized and configured to secure strap 30 therewithin in a fashion as describe above with respect to channels 54 and 55 of the first embodiment. As best seen in FIG. 8, base portion 143 also includes a second T-shaped channel 168, which is located radially inward of channel 154 and opens radially inwardly when the club holder 128 is secured within the mouth portion 26 of golf bag 20.

Figure 10:
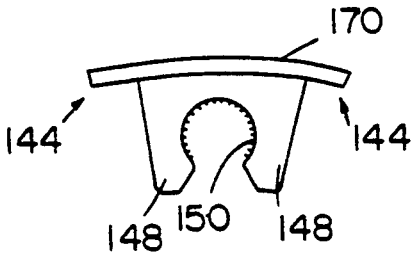
FIG. 10 is a top view of a retainer clip which is slidably receivable within the club holder of FIG. 7.
Figure 11:
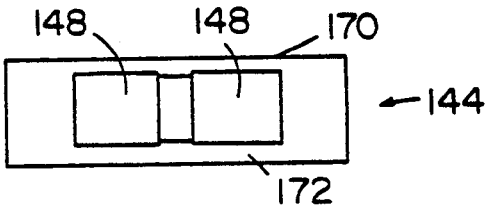
FIG. 11 is a side elevational view of a retainer clip.
Figure 12:
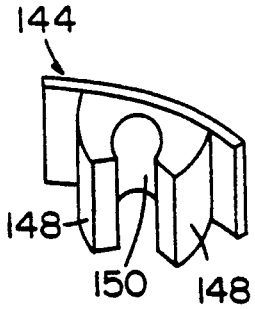
FIG. 12 is a perspective view of the retainer of FIG. 10.

The base portion 143 secures retainer clips 144 which are slidably retained within T-shaped channel 168. As shown in FIGS. 10–12, retainer clips 144 have upper and lower flanges 170 and 172 and a pair of flexible fingers 148, sized and configured to clampingly and releasably retain shafts 42 within an inner aperture 150, which is defined by the fingers 148. The upper and lower flanges 170 and 172 are slidably retained within T-shaped channel 168. A determinable number of retainers 144 may be inserted into channel 168.

Figure 13:
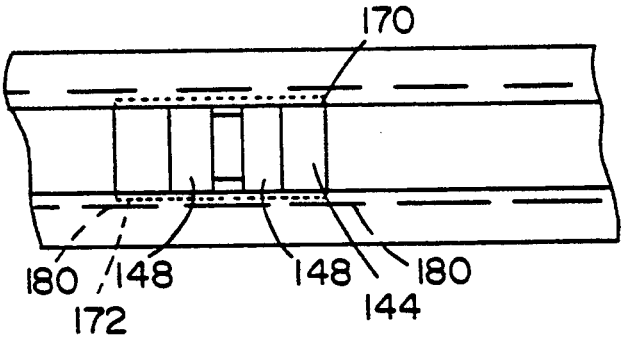
FIG. 13 is a fragmentary section view taken along line 13—13 of FIG. 7.

A plurality of detents 180 may be longitudinally placed along the bottom of channel 168 at positions spaced slightly farther apart than the length of flange 172, as shown in FIG. 13. The retainer clips 144 may then be positioned between the detents 180. To reposition the clips 144, the clips 144 are lifted over the detents 180 and placed between a new pair of detents 180. The channel 168 should sized and configured sufficiently to accommodate the height of the clips 144 when passing over the detents while still retaining the upper flanges 170 when clips 144 are located between a pair of the detents 180, while resting upon the bottom of channel 168.

As seen in FIG. 7, club holder 128 is a longitudinal strip having first and second ends 171 and 173 which have a plurality of projections 174 and apertures 176, respectively. The projections 174 have enlarged heads 178 which are slightly oversized relative to apertures 176. Ends 171 and 173 can be joined, similar in manner to the joining of straps on the back of a baseball hat, with projections 174 being inserted through apertures 176 with enlarged heads 178 being in a press-fit condition relative to apertures 176. By selectively choosing which projections 174 are to be joined with particular apertures 176, the club holder 128 can be adjusted to cooperatively fit within golf bags 20, having inner diameter on the order of 9–11". The club holder 120 can also be manufactured to fit bags of other diameters as well.

In operation, a desired number of retainer clips 144 are slidably inserted in channel 168 being retained therein by upper and lower flanges 170 and 172. Next, the ends 171 and 173 of club holder 128 are placed in overlapping position, appropriate to the diameter of the golf bag 20 into which it is to be releasably affixed, with projections 174 being inserted into apertures 176, thereby providing circular closure. The free end of strap 30 is then threaded through bag opening 34, channel 154, formed by loops 147 and out bag opening 34. After extending across an exterior portion of mouth portion 26, strap 30 is then reinserted in second bag opening 33, the remainder of channel 154 and exiting the remaining bag opening 34. The buckle 31 is then joined to an appropriate aperture 32 in strap 30, thereby releasably affixing club holder 128 with golf bag 20. The golf clubs 38 may then be releasably stored in golf bag 20 in a fashion as described in the first embodiment of club holder 28.

While in the foregoing specification this invention has been described in relation to certain preferred embodiments thereof, many details have been set forth for purpose of illustration, but will be apparent to those skilled in the art that the invention is susceptible to additional embodiments and that certain of the details described herein can be varied considerably without departing from the basic principles of the invention.

What is claimed is:

1. In combination, a golf bag having an open end with a periphery and a strap supported within said open end, and a unitary golf club holder dimensioned to fit within said open end and having a plurality of retainers thereon positioned around said periphery when said holder is withins aid open end for releasably securing golf clubs in said golf bag, said holder having a channel dimensioned for threadably receiving said strap when said holder is within said open end, said channel cooperating with said strap to prevent said holder from being withdrawn from said open end when a golf club is released from one of said retainers.

2. The combination of claim 1 wherien the channel extends substantially around the periphery of the holder to substantially enclose the strap.

3. The combination of claim 1 wherein the golf bag has a closed end and the combination includes a grip support portion dimensioned to fit within the closed end and having a peripherally extending groove for receiving the grips of the golf clubs and oriented and sufficiently narrow to maintain the golf clubs parallel to one another when the golf clubs are retained by the retainers.

4. The invention of claim 3 wherein the grip support portion has a crowned center portion and a peripherally extending outer lip forming the groove therebetween, whereby during insertion into a golf bag, the grip of a golf club may strike the crowned center portion and slide into the groove.

5. The combination of claim 1 wherein:

each of said retainers includes a pair of resilient opposing fingers which are positioned to releasably secure a golf club.

6. A unitary golf club holder dimensioned to fit within the periphery of the open end of a golf bag having a strap supported within said open end, said holder comprising:

a plurality of retainers, each having means for retaining a golf club, positioned around said periphery when said holder is within said open end for releasably retaining respective golf clubs in said golf bag, said holder having a channel dimensioned for threadably receiving said strap when said holder is within said open end, said channel dimensioned to cooperate with said strap to prevent said holder from being withdrawn from said open end when a golf club is released from one of said retainers.

7. The invention of claim 6 wherein said channel extends substantially around the periphery of the holder to substantially enclose the strap.

8. The invention of claim 6 wherein the holder is an integral plastic molding.

9. The holder of claim 6 wherein:

each of said retainers includes a pair of resilient opposing fingers which are positioned to releasably secure a golf club.

10. In combination, a golf bag having an open end and a strap supported within said open end, and a golf club holder dimensioned to fit within said open end and having a plurality of retainers thereon positioned around said open end when said holder is within said open end for releasably retaining a golf club in said golf bag, said holder comprising a base portion, separate from said plurality of retainers, and including means for releasably securing said plurality of retainers to said base portion, said holder having a closed channel dimensioned for threadably receiving said strap when said holder is within said open end, said closed channel cooperating with said strap to prevent said holder from being withdrawn from said open end when a golf club is released from said retainer.

11. The combination of claim 10 wherein said retainers each have a flange thereon and said means for releasably securing said plurality of retainers includes a second channel dimensioned to slidably receive the flanges of said retainers.

12. The combination of claim 10 wherein:

each of said retainers includes a pair of resilient opposing fingers which are positioned to releasably secure a golf club.

13. A golf club holder dimensioned to fit within the open end of a golf bag having a strap supported within said open end, said holder comprising:

a plurality of retainers thereon positioned around said open end when said holder is within said open end for releasably retaining a golf club in said golf bag, said holder comprising a base portion, separate from said plurality of retainers, and including means for releasably securing said plurality of retainers to said base portion, said holder having a closed channel dimensioned for threadably receiving said strap when said holder is within said open end, said closed channel dimensioned to cooperate with said strap to prevent said holder from being withdrawn from said open end when a golf club is released from said retainer.

14. The club holder of claim 13 wherein each retainer includes a flange and said means for releasably securing said plurality of retainers includes a second channel dimensioned for slidably receiving and retaining said flanges of said retainers therein.

15. The invention of claim 14 wherien said second channel has means for selectively positioning said retainers.

16. The invention of claim 15 wherein said means for positioning includes a plurality of longitudinally spaced apart detents which cooperate to position said retainers.

17. The invention of claim 13 wherein the holder is an elongate strip and includes means for conforming to mate with the periphery of the golf bag.

18. The invention of claim 17 wherein the holder has a pair of ends having means for releasably securing the ends together such that the holder is conformable to golf bags having peripheries of different sizes.

19. The invention of claim 18 wherein said means for releasably securing the ends together include projections with enlarged heads and cooperating apertures whereby the ends are releasably securable together in overlying relation.

20. The holder of claim 13 wherein:

each of said retainers includes a pair of resilient opposing fingers which are positioned to releasably secure a golf club.

* * * * *

UNITED STATES PATENT AND TRADEMARK OFFICE

CERTIFICATE OF CORRECTION

PATENT NO. : 5,222,596

DATED : June 29, 1993

INVENTOR(S) : David S. Jordan

It is certified that error appears in the above-identified patent and that said Letters Patent is hereby corrected as shown below:

Column 6, Line 40, Claim 1 delete "withins aid" and insert --within said--.

Signed and Sealed this

Sixth Day of June, 1995

Bruce Lehman

*Attest:*

BRUCE LEHMAN

*Attesting Officer*

*Commissioner of Patents and Trademarks*